US005882498A

United States Patent [19]

Dubin et al.

[11] Patent Number: 5,882,498

[45] Date of Patent: Mar. 16, 1999

[54] METHOD FOR REDUCING OXIDATION OF ELECTROPLATING CHAMBER CONTACTS AND IMPROVING UNIFORM ELECTROPLATING OF A SUBSTRATE

[75] Inventors: Valery Dubin, Cupertino; Takeshi Nogami, Sunnyvale, both of Calif.

[73] Assignee: Advanced Micro Devices, Inc., Sunnyvale, Calif.

[21] Appl. No.: 951,805

[22] Filed: Oct. 16, 1997

[51] Int. Cl.[6] ..... C25D 3/00; C25D 3/56; C25D 7/12; C23C 28/02

[52] U.S. Cl. ..... 205/261; 205/269; 205/271; 205/291; 205/238; 205/252; 205/184; 205/191; 205/123; 205/157; 205/170; 205/181; 205/182; 438/466; 438/597

[58] Field of Search ..... 205/123, 157, 205/170, 181, 182, 238, 252, 261, 269, 271, 291, 184, 191; 438/466, 597

[56] References Cited

U.S. PATENT DOCUMENTS 5,429,733 7/1995 Ishida ..... 204/224 R
5,472,592 12/1995 Lowery ..... 205/137

OTHER PUBLICATIONS

Semitool®, entitled EQUINOX Single Substrate Processing System, EQU 025 1.11–4.11, 6.11 no date available.

*Primary Examiner*—Kathryn Gorgos
*Assistant Examiner*—Edna Wong
*Attorney, Agent, or Firm*—Fliesler, Dubb, Meyer & Lovejoy LLP

[57] ABSTRACT

A method for electroplating a silicon substrate in manufacturing a semiconductive device is provided. Electroplating process chamber contacts or fingers used in positioning a silicon substrate or wafer during an electroplating process are plated with a metal layer to prevent oxidation of the contacts. Oxidation of the contacts may result in increased and varying resistance of the contacts and thus nonuniform plating of the silicon wafer and possibly even deplating of a seed layer. A 20 mA/cm$^2$ current is applied to the contacts which are immersed in an electrolyte solution before loading a silicon wafer. A silicon wafer is then loaded into the electroplating process chamber containing the electrolyte solution. The preplating of the contacts enables the formation of a uniform metal layer on the silicon substrate. Additionally, voltage then may be applied to the contacts after unloading the silicon wafer to reduce oxidation. This electroplating method reduces expensive maintenance time in replacing or cleaning electroplating chamber contacts. The method also does not require expensive and complex electronics to monitor and supply current to the contacts.

21 Claims, 5 Drawing Sheets

METHOD FOR REDUCING OXIDATION OF ELECTROPLATING CHAMBER CONTACTS AND IMPROVING UNIFORM ELECTROPLATING OF A SUBSTRATE

FIELD OF THE INVENTION

The present invention relates to a method for plating a metal onto a substrate, and in particular, a method for uniformly electroplating a metal onto a semiconductor device.

BACKGROUND OF THE INVENTION

An electroplating process may be used in manufacturing semiconductor devices. Metal interconnect structures are formed on a silicon substrate, such as a silicon wafer, to provide electrical connections between transistors. Trenches are formed in the silicon substrate for depositing metal used to form the interconnect structures. Typically, a barrier layer and a seed layer of metal is then deposited on the silicon substrate. The silicon substrate is then immersed into an electroplating process chamber containing an electrolyte solution. Typically, an anode is then positioned in the electrolyte solution and a cathode is coupled to the silicon substrate for providing an electrical current. The electric current, electrolyte solution, and substrate then react to form a metal layer on the substrate surface, including in the trenches of the silicon substrate. Conductive process chamber contacts or fingers are typically used to position the silicon substrate in the electrolyte solution. These contacts may also be used to provide a current path.

A number of different types of contacts have been used in various electroplating process chambers. For example, U.S. Pat. No. 5,472,592 ("'592 Patent") entitled "Electrolytic Plating Apparatus and Method", inventor Kenneth J. Lowery, issued Dec. 5, 1995, which is incorporated by reference, describes an apparatus used in electroplating substrates. The '592 Patent describes an apparatus for plating a substrate positioned vertically. Three spring-like contacts are used to position a silicon wafer during the plating process. The '592 patent teaches a complex multichannel power supply and monitoring system, coupled to each contact which enables uniform plating.

U.S. Pat. No. 5,429,733 ("'733 Patent") entitled "Plating Device for Wafer", inventor Hirofumi Ishida, issued Jul. 4, 1995, which is incorporated by reference, also describes a plating device. The '733 Patent describes an apparatus for plating a silicon wafer positioned horizontally. Cathode electrodes and elastic members are used to position the silicon wafer against an air bag.

An EQUINOX single substrate processing system by SEMITOOL® also provides an electroplating process chamber having four to six contacts or "fingertips" for positioning a silicon wafer during the electroplating process.

After a metal layer is formed during the electroplating process, typically, the silicon substrate is removed from the electrolyte solution. The silicon substrate may be transferred to another process chamber, such as a spin/rinse/dry chamber. The electroplating process chamber contacts which may be covered with a residue of electrolyte solution then may become oxidized as they are exposed to oxygen. The contacts may even become oxidized if immersed into the electrolyte solution without the silicon substrate.

The oxidation of the contacts may cause undesirable consequences in subsequent electroplating. The oxidation of the contacts increases the resistance of the contacts. The increased resistance may also not be the same for each contact because some contacts may be more oxidized than others. Thus, a predetermined amount of voltage applied to each contact will create different amounts of current at the respective contacts. This increase and varying resistance of the contacts will cause nonuniform plating. Further, this oxidation of the contacts may even cause seed layer deplating at the portion of the silicon substrate which touches the contact.

The oxidized contacts may be cleaned with a solution such as, nitric acid. However, this cleaning process requires the electroplating process chamber to be taken off line and limits valuable manufacturing capability. Further, the contacts may have to be removed from the electroplating process chamber or replaced requiring further costly and complex maintenance tasks.

The '592 patent teaches a complex monitoring and multichannel power supply to enable uniform plating. However, the added complexity and components described in the '592 patent increases the cost and maintenance of the electroplating process chamber.

Therefore, it is desirable to provide a method for providing uniform electroplating on the surface of a silicon substrate without the increased costs associated with cleaning or replacing contacts. Further, it is desirable to have a method which does not require complex electronics or further components in an electroplating process chamber which increase the cost of maintaining and/or purchasing the electroplating process chamber.

SUMMARY OF THE INVENTION

A method for reducing the oxidation of contacts used in positioning silicon substrates in an electroplating process chamber is provided. The method reduces the oxidation of the contacts and thus reduces the increased and varying resistance of the respective contacts which may lead to a nonuniform layer deposited on the silicon substrate during the electroplating process. The method does not require the use of cleaning fluids or disassembling the electroplating process chamber contacts during complex and costly maintenance tasks. Thus, the electroplating process chamber does not have to be taken off line and may be more efficient in processing silicon substrates. Further, the method does not require additional complex and costly electronics for monitoring and supplying current.

According to one aspect of the present invention, a method for electroplating a substrate comprises the steps of immersing an electroplating process chamber contact for positioning the silicon substrate into an electrolyte solution. A first current amount is then applied to the contact for plating the contact with a metal. The substrate is then positioned with the contact and immersed into an electrolyte solution. A second current amount is then applied to the substrate for forming a metal layer on the substrate.

According to another aspect of the present invention, the metal is copper, nickel, cobalt or a tin-lead alloy.

According to another aspect of the present invention, the first current amount is approximately 20 $mA/cm^2$.

According to another aspect of the present invention, a copper layer is formed on the substrate having a uniformity of within approximately 5%, one standard deviation (1 sigma).

According to another aspect of the present invention, the method further includes the step of removing the substrate and the contact from the electrolyte solution, removing the substrate from the contact, immersing the contact into the electrolyte solution, and applying a second current to the contact.

According to another aspect of the present invention, a method for electroplating a silicon wafer with copper using an electroplating process chamber containing an electrolyte solution comprises the steps of immersing a plurality of contacts into the copper electrolyte solution. Applying an approximately 20 mA/cm$^2$ current to the plurality of contacts for plating the plurality of contacts with a metal layer of copper. The plurality of contacts are then removed from the copper electrolyte solution. A silicon wafer is then positioned on the plurality of contacts. The plurality of contacts and silicon wafer is then immersed into the electrolyte solution. A current is applied to the plurality of contacts for plating the silicon wafer with a metal layer of copper.

According to another aspect of the present invention, the plurality of contacts and silicon wafer is then removed from the copper electrolyte solution. The plurality of contacts are then immersed into the electrolyte solution and an approximately less than 15 mA/cm$^2$ current is applied to the plurality of contacts.

According to another aspect of the present invention, the method further comprises the steps of forming a trench in the silicon wafer and forming a tantalum barrier layer on the silicon wafer. A copper seed layer is then formed on the tantalum layer.

Other aspects and advantages of the present invention will be apparent upon review of the figures, the detailed description, and the claims which follow.

DESCRIPTION OF THE INVENTION

In the following description, numerous details, for example, specific materials, process steps, and so on, are set forth in order to provide a thorough understanding of the present invention. It will be obvious, however, to one skilled in the art of the specific details which need not be employed to practice the present invention. Moreover, specific details of particular processes or structures may not be specifically presented in order to not unduly obscure the invention where such details would be readily apparent to one of average skill in the art.

Figure 1A:
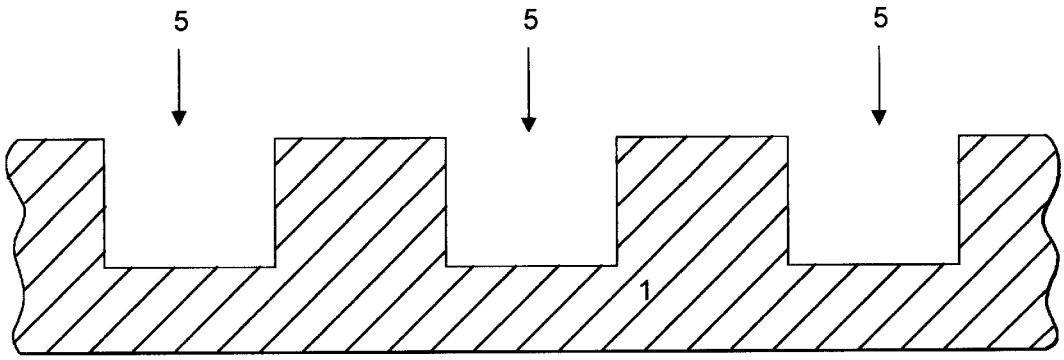
FIGS. 1A–E illustrate a plurality of semiconductor device manufacturing steps for forming metal interconnect structures when using the electroplating method according to the present invention.

FIG. 1A illustrates a cross-section of a silicon substrate 1. In an embodiment, the silicon substrate 1 is a 8" (or approximately 20.3 cm) diameter circular silicon wafer. In an embodiment, the silicon substrate 1 may be a silicon wafer having trenches 5 formed in interlevel dielectric by a previous etching step.

Figure 1B:
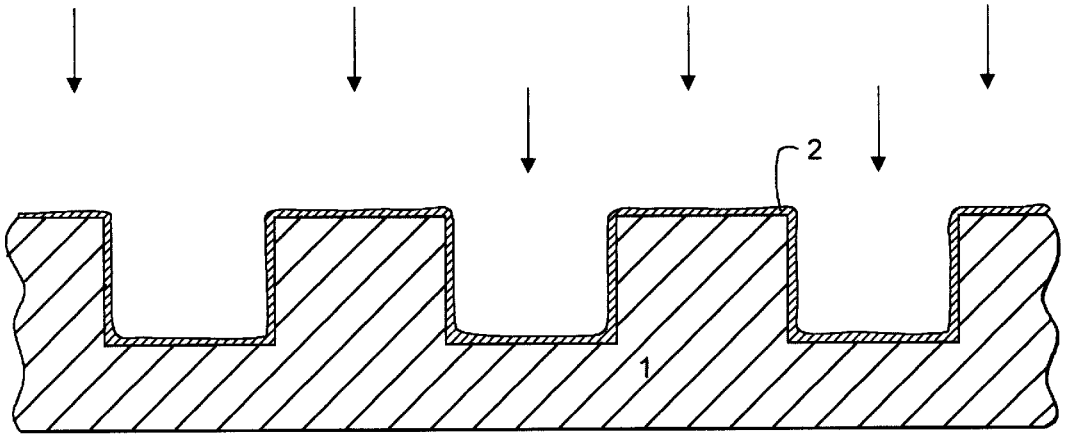

FIG. 1B illustrates the forming of a barrier layer 2 on the silicon substrate 1. In an embodiment, barrier layer 2 may be tantalum (Ta), tungsten (W), chromium (Cr), TaN, WN, TiN, TaSiN, WSiN, or TiSiN. In an embodiment, a sputtered tantalum barrier layer 2 is approximately 30 nm thick.

Figure 1C:
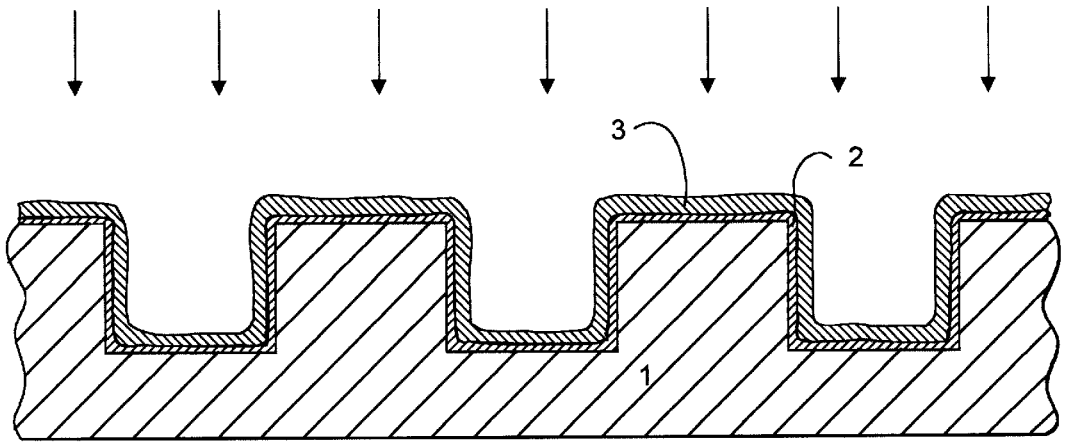

FIG. 1C illustrates the forming of a metal seed layer 3 on the barrier layer 2. In an embodiment, the metal seed layer 3 may be nickel (Ni), copper (Cu), cobalt (Co), tin-lead (SnPb) alloy or equivalent metal or alloys. In an embodiment, seed layer 3 is an approximately 100 nm thick copper seed layer.

Figure 1D:
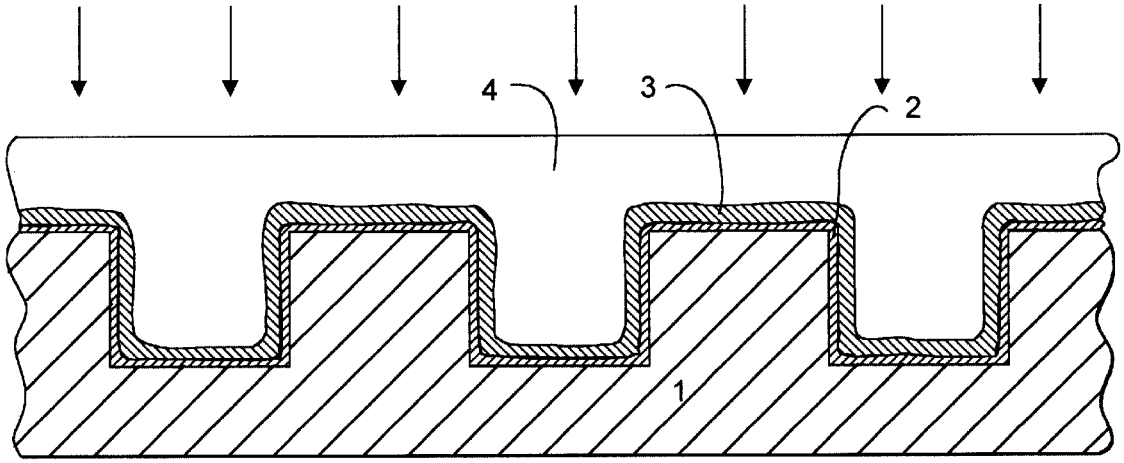

FIG. 1D illustrates the forming of a metal 4 on the silicon substrate 1 in an electroplating process step. As can be seen from FIG. 1D, a metal layer 4 is formed on the surface of seed layer 2. In an embodiment, metal layer 4 is a copper metal layer.

Figure 2:
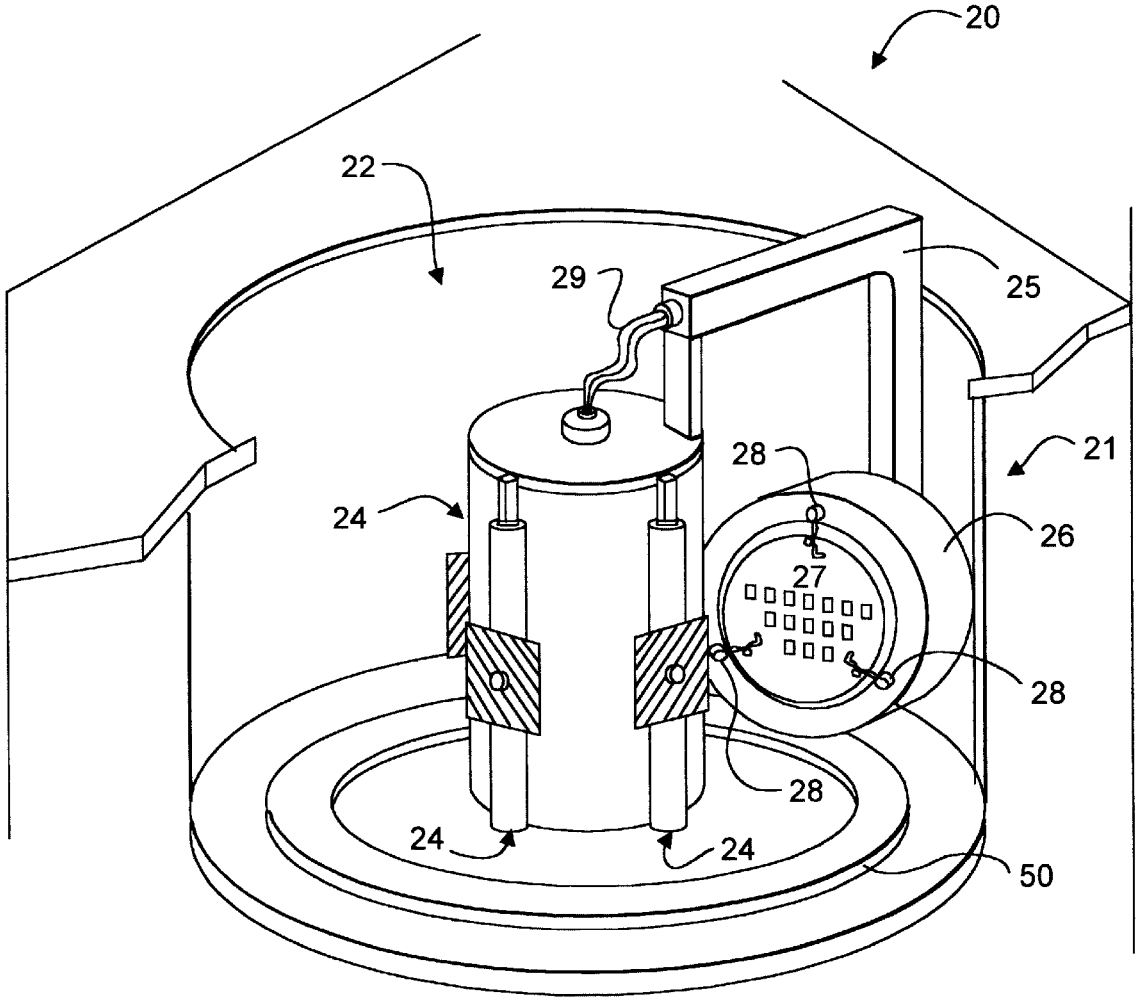
FIG. 2 (PRIOR ART)
FIG. 2 illustrates an electroplating apparatus having a first type of contact for positioning a silicon substrate in an electrolyte solution.
Figure 3:
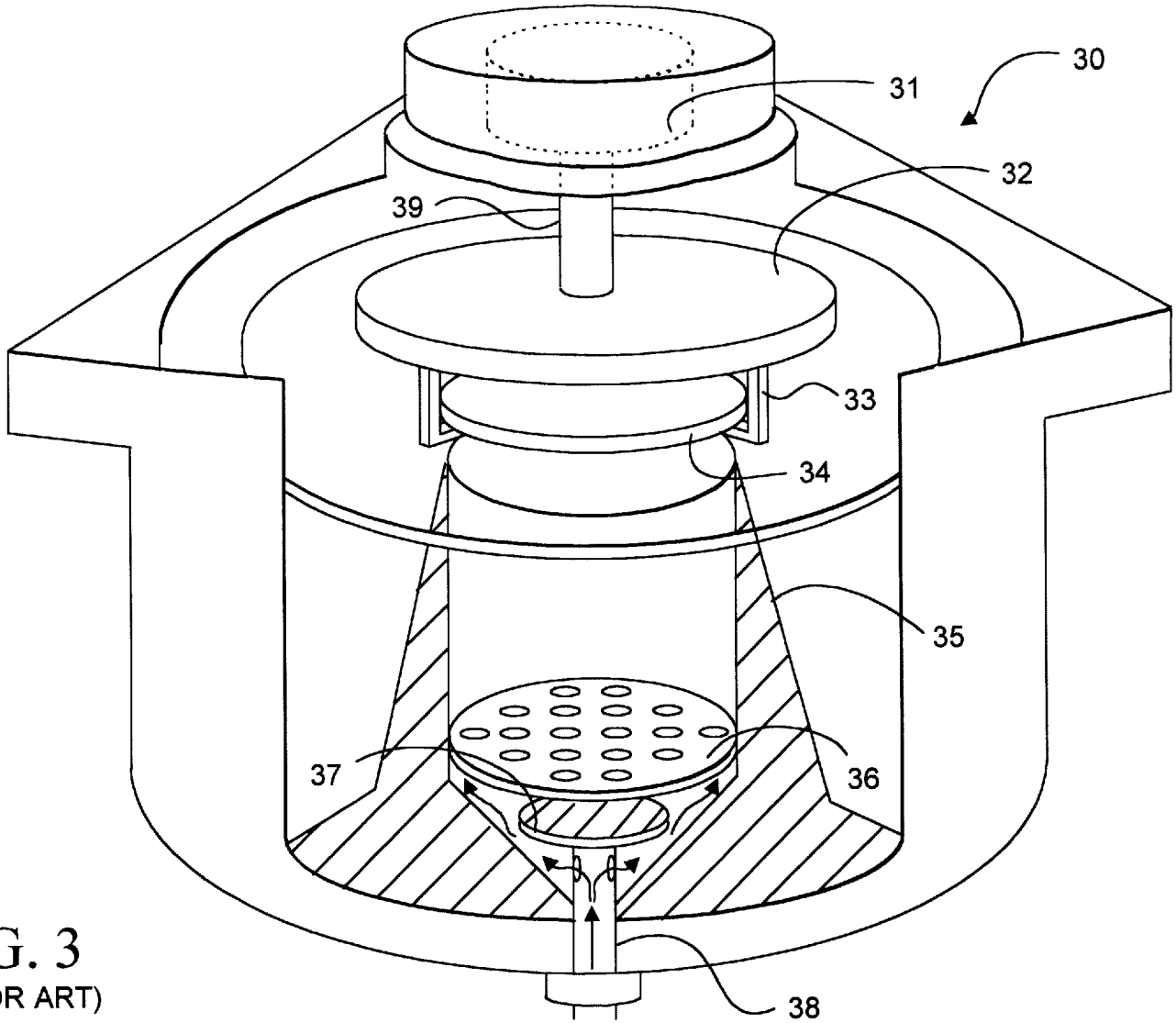
FIG. 3 (PRIOR ART)
FIG. 3 illustrates an electroplating apparatus having a second type of contact for positioning a silicon substrate in an electrolyte solution.
Figure 4:
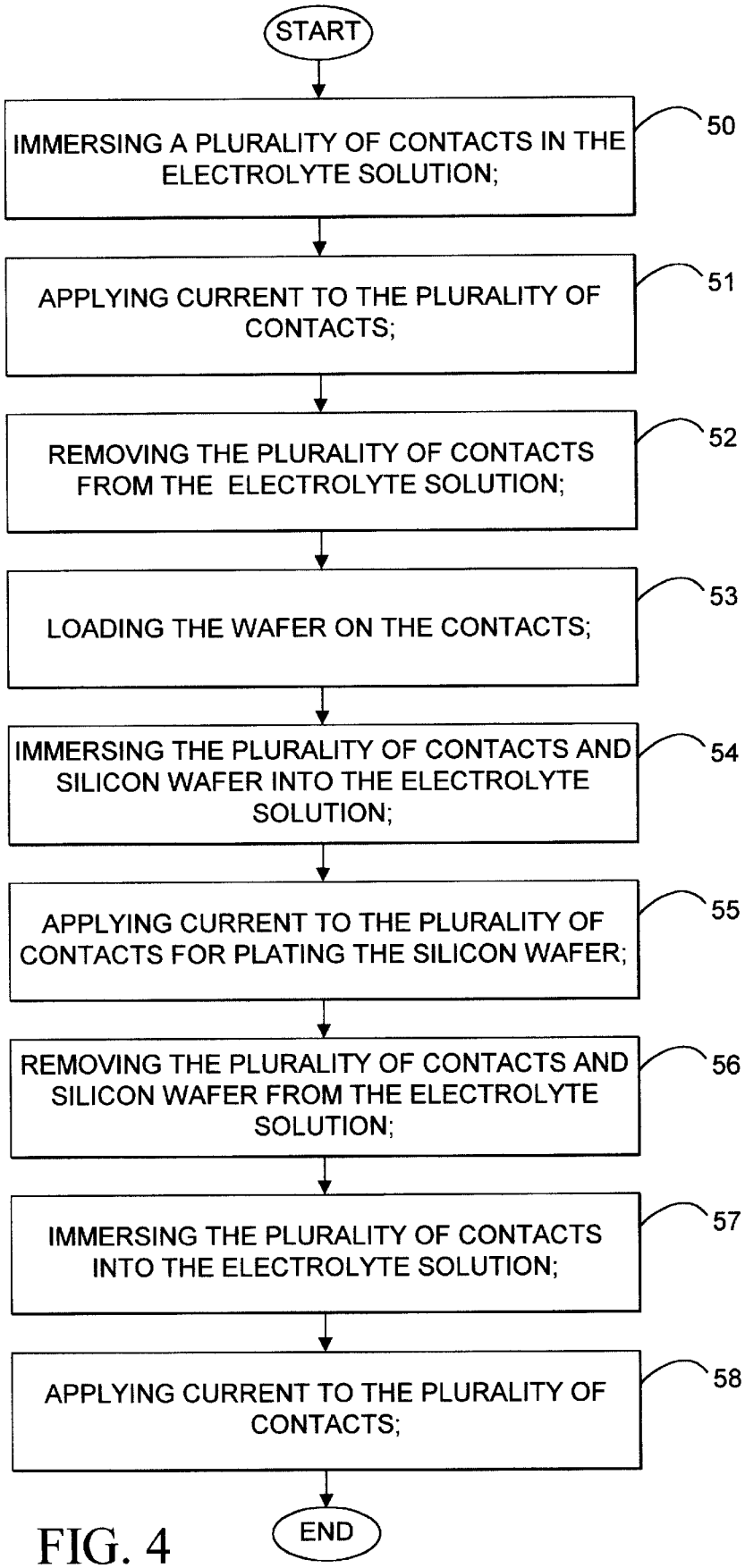
FIG. 4 is a logic flow diagram illustrating a method for reducing oxidation of contacts and enhancing uniform plating of substrates according to the present invention.

In an embodiment, silicon substrate 1 illustrated in FIG. 1D may be positioned in an electrolyte solution contained in an electroplating processing chamber illustrated in FIGS. 2 and 3. In an embodiment for forming a copper metal layer, the electrolyte solution is an Enthone-OMI's CUBATH™ solution and is formed by the method described below and illustrated in FIG. 4.

Figure 1E:
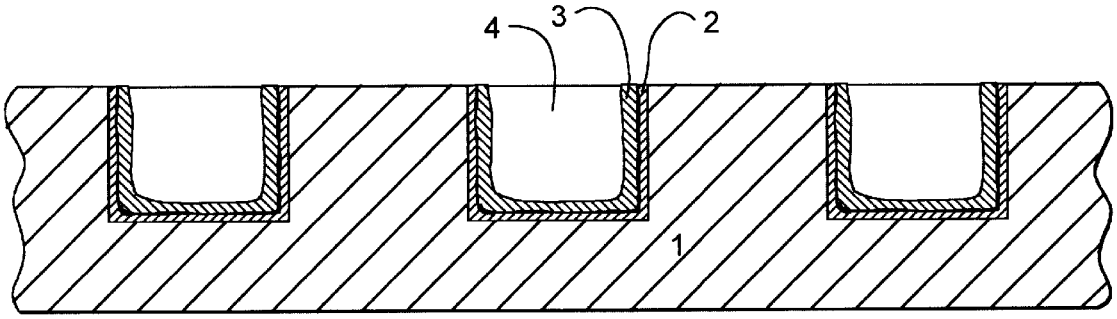

FIG. 1E illustrates the silicon substrate 1 after a chemical metal polishing step ("CMP"). The CMP step removes a portion of metal layer 4 as well as the barrier layer 2 from the top surface of silicon substrate 1. Metal layer 4 formed in trenches 5 then may be used to interconnect transistors formed in silicon substrate 1. In an embodiment, additional metal interconnect structures may also be formed on top of the silicon substrate 1 illustrated in FIG. 1E.

FIG. 2 illustrates an electroplating process chamber 20 used in forming a metal layer on a silicon substrate. In particular, spring conductive contacts 28 position silicon wafer 27 vertically against wheel 26 which is coupled to arm 25. Rotating assembly 22 rotates arm 25 in plating tank 21. A plurality of anode assemblies 24 are also coupled to rotating assembly 22. Wires 29 connect contacts 28 and anode assembly 24 to a power supply. Process chamber 20 may also include complex power and monitoring components to provide current.

In an embodiment, an electrolyte solution, such as a copper electrolyte solution is added to tank 21. A current is then provided by way of anode assembly 24, contacts 28, a power supply and an electrolyte solution to create a metal layer on silicon wafer 27 as illustrated in FIG. 1D. Current passes from the anode assemblies 24 to silicon wafer 27 through the electrolyte solution in tank 21. It should be readily apparent to one of average skill in the art that components of chamber 20 in accordance with the present invention are illustrated and described. Components not necessary in providing the present invention are not shown or described.

A method for reducing oxidation of contacts 28 and enabling a uniform metal plating of silicon wafer 27 using electroplating process chamber 20 without complex power and monitoring components is described below.

FIG. 3 illustrates another electroplating process chamber 30 having "fingertips" 33 for positioning silicon wafer 34. Electroplating process chamber 30 includes a brushless direct current (DC) drive motor 31 for rotating silicon wafer 34. Brushless DC drive motor 31 is coupled to head 32 by shaft 39. Head 32 is coupled to silicon wafer 34 which acts as a cathode by fingertips 33. Anode 37 is coupled to anode post 38. Silicon wafer 34 is positioned by four platinized titanium fingertips. In an alternate embodiment, six fingertips may be used. Chemical tube/anode post 38 provides electrolyte solution to electroplating process chamber 30. In particular, a diffuser 36 and electroplating cup 35 directs the electrolyte solution to the surface of silicon wafer 34 from tube 38. In an embodiment, a similar electrolyte solution, barrier layer, and seed layer as described above is used in electroplating silicon wafer 34. During electroplating, an electric current is supplied to the electrolyte solution by anode 37, cathode 34 and a power supply. It should be readily apparent to one of average skill in the art that only certain components of chamber 30 in accordance with the present invention are illustrated and described. Components not necessary in providing the present invention are not shown or described.

As can be seen, the fingertips 33 illustrated in FIG. 3 are different from the spring-like contacts 28 illustrated in FIG. 2; however, each contact is subjected to oxidation and the subsequent problems in uniform plating. It should also be understood by one of ordinary skill in the art, that while two types of contacts for positioning a silicon wafer are described and illustrated, many other equivalent types of contacts may be used in accordance with the present invention.

FIG. 5 illustrates a logic flow diagram for reducing the oxidation of contacts used for positioning silicon substrates in electroplating process chambers and allowing for uniform plating according to the present invention. The present method may be used with the electroplating process chambers illustrated in FIGS. 2 and as well as other process chambers having similar or different conductive contacts or fingertips. Further, the present method can be used in electroplating a variety of metals including, but not limited to, copper, nickel, and cobalt or equivalent metal or alloy.

According to one embodiment of the present invention, contacts are preplated before electroplating a silicon wafer to reduce oxidation of the contacts. The contacts are immersed in an electrolyte solution as illustrated in logic block 50. An approximately 20 mA/cm$^2$ current is applied to the contacts as illustrated in logic block 51 in order to plate the contacts with a layer of metal. After the contacts are plated, the silicon wafer is loaded onto the contacts as illustrated by logic block 53. The silicon wafer and contacts are then immersed into the electrolyte solution and a current is applied as illustrated in logic blocks 54 and 55, respectfully. In an embodiment, the electrolyte solution is an Enthone-OMI's CUBATH™ plating solution which may form a copper metal layer thickness of approximately 1.5 $\mu$m on the silicon wafer. The silicon wafer is then removed from the electroplating process chamber as illustrated in logic block 56. In an embodiment, the contacts are then immersed into the electrolyte solution as illustrated in logic block 57 and a current less than approximately 15 mA/cm$^2$ is supplied to the contacts as illustrated in logic block 58. The current is supplied to reduce any copper oxide formation on the surface of the contacts. This will also create a fresh copper layer on the surface of the contacts.

Typically, an electroplating process step is one of many steps performed in manufacturing a semiconductor device. A cluster tool may be used in manufacturing a semiconductor device. A cluster tool may include an electroplating process chamber as well as other process chambers, such as a coater, spinner, and/or polisher. Typically, a silicon wafer is unloaded from the electroplating process chamber in order to complete another process step. In this situation, the contacts may be either immersed or removed from the electrolyte solution while waiting to process the next silicon wafer in the electroplating chamber.

In an embodiment of the present invention, a relatively low current is applied to the contacts submerged in the electrolyte solution in order to prevent oxidation. For example, an approximately less than 15 mA/cm2 current is applied to the contacts immersed in the solution before the next electroplating process.

If the contacts are not immersed into the electrolyte solution while waiting for the next electroplating process, a voltage of approximately 1.5 to approximately 2.0 volts may be applied to the contacts.

The method described above in which contacts were preplated before electroplating a silicon substrate enables formation of a uniform metal layer on the silicon wafer. Without using the above described preplating contact method, a copper layer on a 8" wafer had a uniformity of 20%, one standard deviation (1 sigma) when using the electroplating chamber illustrated in FIG. 3. When using the method illustrated in FIG. 4, the copper thickness uniformity on an 8" wafer using the electroplating process chamber illustrated in FIG. 3 was 5%, one standard deviation (1 sigma). Thus, the present method enabled an electroplating metal uniformity performance increase of over 400% without the use of cleaning fluids or complex electronics.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method for electroplating a substrate, comprising the steps of:

(a) immersing a contact for positioning the substrate into an electrolyte solution;

(b) applying a first current amount to the contact for plating only the contact with a metal layer;

(c) positioning the substrate with the plated contact in the electrolyte solution; and (d) applying a second current amount to the substrate for forming a metal layer on the substrate.

2. The method of claim 1, wherein the metal layer on the contact and the substrate is copper.

3. The method of claim 1, wherein the metal layer on the contact and the substrate is nickel.

4. The method of claim 1, wherein the metal layer on the contact and the substrate is cobalt.

5. The method of claim 1, wherein the metal layer on the contact and the substrate is tin-lead (SnPb) alloy.

6. The method of claim 1, wherein the first current amount is approximately 20 mA/cm$^2$.

7. The method of claim 2, wherein the copper layer on the substrate is approximately 1.5 $\mu$m thick.

8. The method of claim 2, wherein the copper is uniform within approximately 5%.

9. The method of claim 1 wherein the substrate is an approximately 8" silicon wafer.

10. The method of claim 9, wherein the silicon wafer includes a trench having a barrier layer and a seed layer.

11. The method of claim 1, further including the steps of:

(e) removing the contact and substrate from the electrolyte solution;

(f) removing the substrate from the contact;

(g) immersing the contact into the electrolyte solution; and, (h) applying less than approximately 15 $mA/cm^2$ to the contact.

12. The method of claim 1, further including the steps of:

(e) removing the contact and substrate from the electrolyte solution;

(f) removing the substrate from the contact; and, (g) applying approximately 1.5 to approximately 2.0 V to the contact.

13. A method for electroplating a silicon wafer with a copper layer using an electroplating process chamber having a plurality of contacts and containing a copper electrolyte solution, comprising the steps of:

(a) immersing the plurality of contacts into the copper electrolyte solution;

(b) applying an approximately 20 $mA/cm^2$ current to the plurality of contacts for plating only the plurality of contacts with a layer of copper;

(c) removing the plurality of copper plated contacts from the copper electrolyte solution;

(d) positioning the silicon wafer on the plurality of copper plated contacts;

(e) immersing the plurality of copper plated contacts and silicon wafer into the electrolyte solution; and, (f) applying a current to the plurality of copper plated contacts for plating the silicon wafer with the layer of copper.

14. The method of claim 13, further including the steps of:

(g) removing the plurality of contacts and the silicon wafer from the electrolyte solution;

(h) immersing the plurality of contacts into the electrolyte solution; and, (i) applying an approximately less than 15 $mA/cm^2$ current to the plurality of contacts.

15. The method of claim 13, further including the steps of:

(g) removing the plurality of contacts and the silicon wafer from the electrolyte solution;

(h) removing the silicon wafer from the contacts; and, (i) applying a voltage of approximately 1.5 to approximately 2.0 V to the plurality of contacts.

16. The method of claim 13, wherein the method further includes the steps of:

(g) forming a trench in an interlevel dielectric in the silicon wafer;

(h) forming a tantalum layer on the silicon wafer; and, (i) forming a copper seed layer on the tantalum layer.

17. The method of claim 16, wherein the copper seed layer is approximately 100 nm thick.

18. The method of claim 16, wherein the tantalum layer is approximately 30 nm thick.

19. The method of claim 13, wherein the plurality of contacts includes 6 contacts.

20. The method of claim 13, wherein the copper layer of the silicon wafer is uniform within approximately 5%, 1 sigma.

21. The method of claim 13, wherein the silicon wafer is an approximately 8" silicon wafer.

* * * * *

UNITED STATES PATENT AND TRADEMARK OFFICE

CERTIFICATE OF CORRECTION

PATENT NO. : 5,882,498

DATED : March 16, 1999

INVENTOR(S) : Dubin, et al.

It is certified that error appears in the above-identified patent and that said Letters Patent is hereby corrected as shown below:

Column 7, line 4, after "15 mA/cm$^2$" insert -- current --; and

Column 7, line 11, after "applying" insert -- a voltage of --.

Signed and Sealed this

First Day of February, 2000

*Attest:*

*Attesting Officer*

Q. TODD DICKINSON

*Acting Commissioner of Patents and Trademarks*

Adverse Decision in Interference

Patent No. 5,882,498, Valery Dubin, Takeshi Nogami, METHOD FOR REDUCING OXIDATION OF ELECTROPLATING CHAMBER CONTACTS AND IMPROVING UNIFORM ELECTROPLATING OF A SUBSTRATE, Interference No. 104,642, final judgment adverse to the patentees rendered August 13, 2002, as to claims 1-3 and 6-10.

(*Official Gazette, October 1, 2002*)